US006676372B2

(12) United States Patent
Scholz et al.

(10) Patent No.: US 6,676,372 B2
(45) Date of Patent: Jan. 13, 2004

(54) GAS TURBINE WITH AXIALLY MUTUALLY DISPLACEABLE GUIDE PARTS

(75) Inventors: Christian Scholz, Berlin (DE); Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/120,808

(22) Filed: Apr. 11, 2002

(65) Prior Publication Data

US 2002/0164246 A1 Nov. 7, 2002

(30) Foreign Application Priority Data

Apr. 12, 2001 (EP) ..... 01109198

(51) Int. Cl.[7] ..... F01D 11/22
(52) U.S. Cl. ..... 415/173.2; 415/173.3
(58) Field of Search ..... 415/173.2, 173.3, 415/173.1, 126, 128

(56) References Cited

U.S. PATENT DOCUMENTS 3,227,418 A * 1/1966 West ..... 415/173.1
3,520,635 A * 7/1970 Killman et al. ..... 415/173.2
4,177,004 A 12/1979 Riedmiller et al.
5,203,673 A 4/1993 Evans
2002/0150469 A1 * 10/2002 Bolms ..... 415/173.2

FOREIGN PATENT DOCUMENTS

DE 1 426 818 3/1969
DE 2 165 528 7/1973

* cited by examiner

*Primary Examiner*—Christopher Verdier

(57) ABSTRACT

A gas turbine with axially mutually displaceable guide parts that compensates for differing amounts of thermal expansion, comprising guide parts which can be displaced with respect to one another in the axial direction and enclose a funnel-like gas duct from outside. In order to optimize a rotor blade tip gap, at least one of the funnel-like guide parts under control by means of a motor can be displaced. As a result of the axial displacement, because of the funnel-like shape of the guide parts, the width of the rotor blade tip gap is changed.

13 Claims, 1 Drawing Sheet

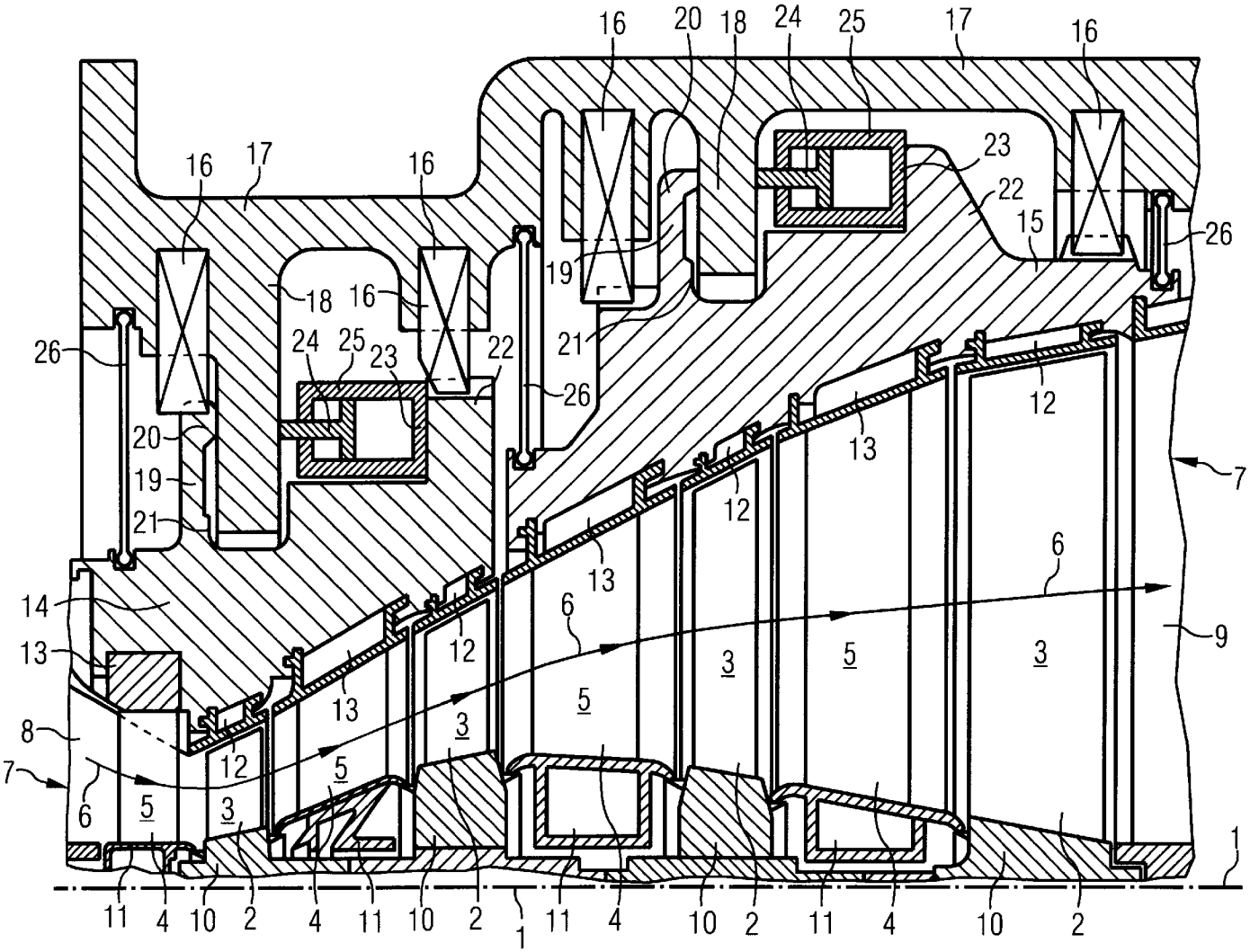
1
2
3
4
5
6
7
8
9
10
11
12
13
14
15
16
17
18
19
20
21
22
23
24
25
26

GAS TURBINE WITH AXIALLY MUTUALLY DISPLACEABLE GUIDE PARTS

CROSS-REFERENCE TO RELATED APPLICATIONS

This application claims priority to EP/01109198.0, filed Apr. 12, 2001 under the European Patent Convention and which is incorporated by reference herein in its entirety.

FIELD OF THE INVENTION

The invention relates to a gas turbine having a ring of stator blades and a ring of rotor blades in a gas duct, and having a casing and funnel-like guide parts which are secured against rotation therein and are axially mutually displaceable, as carriers for rings forming an outer jacket of the gas duct.

BACKGROUND OF THE INVENTION

Gas turbines are often acted on by changing loads, not only during their starting phase but also during continuous operation. The result is nonsteady-state operation, in particular also with regard to the temperatures assumed by the individual components. In order to avoid damage to the turbine, the individual components are therefore usually clamped in in such a way that they can execute thermally induced dimensional changes without hindrance.

In order largely to minimize turbine losses resulting from cross flows over the tips of their rotor blades, the smallest possible radial gaps have to be maintained between the tips of the rotor blades and the guide surfaces lying opposite the latter. Since both the rotor blades and their rotor and stator blades and their carriers, just like a casing which connects them all, viewed over time expand and/or shrink to a different extent at each load change, an optimal radial gap over the tips of the rotor blades is established only for very few of arbitrarily many steady operating states. The operation of these gas turbines is therefore frequently carried out with a gap width which is not optimized and, therefore, with an efficiency which is not optimized.

U.S. Pat. No. 4,177,004 discloses a turbine configuration in which the tips of the rotor blades themselves remove material from a guide surface lying opposite them, so that for this arrangement, in the operating state in which the tips of the rotor blades approach the guide surfaces to the greatest extent, the rotor blade tip gap virtually disappears. In every other operating state, however, even in this known arrangement, the rotor blade tip gap becomes greater again and therefore less beneficial.

In the case of other previously disclosed arrangements, although it has been possible to keep the thermally induced relative movements of the components low for many operating states by selecting suitable pairs of materials, it is also true there that an optimum rotor blade tip gap in each case prevails only in a specific steady state. In every other state, less beneficial conditions again occur.

SUMMARY OF THE INVENTION

The invention is, then, based on the object of developing a gas turbine system in such a way that an optimum rotor blade tip gap is provided in it over a large number of operating states, so that a basic precondition for achieving a good efficiency is ensured.

According to the invention, for a gas turbine of the type specified at the beginning, this object is achieved in that at least one of the funnel-like guide parts can be displaced axially under control by a motor. Expediently, in this case the motor used is a large number of hydraulic presses distributed over the circumference of the guide part. However, any other type of drive is also the content of this invention. The particular advantage of this arrangement lies in the possibility of setting the rotor blade tip gap actively by means of axial movement of the guide part. In the case of restricting the active adjustability to axial movements, use is advantageously made of the conicity provided by the flared or funnel-like shape of the guide part since, because of this conicity, any axial displacement of the same also has the effect of changing the rotor blade tip gap, to be considered substantially radially.

Other objects and advantages of this invention will become apparent from the following description taken in conjunction with the accompanying drawings wherein are set forth, by way of illustration and example, certain embodiments of this invention. The drawings constitute part of this specification and include exemplary embodiments of the present invention and illustrate various objects and features thereof.

BRIEF DESCRIPTION OF THE DRAWING

The invention is explained in more detail below with reference to the exemplary embodiments shown in a schematic manner in the included FIGURE, which shows a partial longitudinal section through a gas turbine according to the present invention.

DETAILED DESCRIPTION OF THE INVENTION

Rings of rotor blades 2 having a large number of rotor blades 3 are keyed onto a turbine shaft 1, not specifically illustrated. A gas stream 6 guided by rings of stator blades 4 having a large number of stator blades 5 expands through a gas duct 7 and, in the process, drives the rotor blades 3.

The gas duct 7 has an annular cross section and, at its pressurized end, is connected to a hot gas chamber 8, from which compressed and heated gas is driven in the direction of an arrow to a gas outlet opening 9. A radially inner boundary of the gas duct 7 is formed by hubs 10 of the rings of rotor blades 2 keyed onto the turbine shaft 1, and by nonrotating hubs 11 of the rings of stator blades 4 carried by the inner ends of the stator blades 5. Joints between the hubs 10 and the hubs 11 are closed by means of labyrinth seals.

A radially outer boundary of the gas duct 7 has a funnel-like, conical shape and is formed by tapered rings 12 and 13. The rings 12 and 13 are carried by flared, funnel-like guide parts 14 and 15, the rings 12 lying opposite the free ends of the rotor blades 3, and the rings 13 holding the outer ends of the stator blades 5 and therefore overall carrying the ring of stator blades 4 formed by them. Gaps between the rings 12 and 13 are closed by means of suitable sealing rings, not illustrated.

The guide parts 14 and 15 have thick walls, are very rigid and are mounted such that they can be displaced axially on blocks 16, which preferably have a rectangular cross section; other suitable cross sections may be chosen for the blocks, as desired. The blocks 16 are anchored in a casing 17, and each of the guide parts 14 and 15 engages at both its ends in each case in a ring formed from a group of blocks 16, so that tilting of the guide parts 14 and 15 is likewise ruled out, as are radial movements.

As a result of its shape and its wall thickness, the casing 17 is likewise rigid, like the guide parts 14 and 15, and on its inner side, apart from the blocks 16, each guide part 14 and 15 bears a rigid rib 18. This rigid rib 18 is in each case provided axially between the rings of blocks 16 which are associated with the same guide part 14 or 15. The rigid rib 18 is in particular also virtually nondeformable in the axial direction.

Each of the guide parts 14 and 15 bears a comparatively thin-walled stop rib 19 which projects radially outward and is supported on the side of the associated rigid rib 18 facing the hot gas chamber 8 by a bead 20 borne by its free end. Arranged at the foot of the stop rib 19 is a reinforcement 21 which, although it likewise faces the rigid rib 18, is shorter in the axial direction than the bead 20.

In their area facing the gas outlet opening 9, the guide parts 14 and 15 are enclosed radially on the outside by a stiffening rib 22, which preferably has a trapezoidal cross section and has a radially oriented stop face 23 located opposite the associated rigid rib 18; the stiffening ribs 22 may also have other suitable shapes as desired. Arranged between the rigid ribs 18 and the stop face 23 respectively located opposite it are hydraulic press assemblies, which include pistons 24 and cylinders 25, distributed uniformly over the circumference of the associated guide parts 14 or 15. The pistons 24 are supported directly on the rigid rib 18, and associated cylinders 25 rest on the stop face 23 of the stiffening rib 22. An annular space between the casing 17 and the guide parts 14 and 15 is subdivided into chambers by diaphragm-like intermediate walls 26.

All the press pistons 24 and cylinders 25 associated with a given guide part 14 or 15 together in each case act as a linear motor, which displaces the guide part 14 or 15 on which it acts axially with respect to the casing 17, in the direction of the gas outlet opening 9. During this displacement, the stop rib 19 rests with its bead 20 on the rigid rib 18 and is deformed elastically. The rings 12 carried by the funnel-like guide parts 14 and 15 lie approximately on the outside of a cone and, during axial displacement, change the width of the rotor blade tip gap. In order to rule out a ring 12 scraping on the tips of the rotor blades 3, the axially possible displacement of the guide parts 14 and 15 is limited. For this purpose, use is made as an end stop of the reinforcement 21 as a stop on the rigid rib 18.

During start-up of the gas turbine, just like during any load change, a thermally unstable state prevails on virtually all the parts provided with reference symbols. In this case, the rates of change on the individual parts are very different, so that correspondingly different thermal expansion and shrinkages occur on these parts. These different temperature changes accordingly lead to relative movements of the parts with respect to one another, in particular changes in the width of the gap between the rings 12 and the tips of the rotor blades 3 located opposite these having a not insignificant influence on the efficiency of the turbine.

The arrangement according to the invention now permits a specific, active adjustment precisely of the width of this gap. For this purpose, this width is measured by means of sensors, not illustrated. If a reduction in the gap width is desired, the relevant guide part 14 and/or 15 is displaced in the direction of the gas outlet opening 9 by the motion of the above-described presses. In the process, the stop rib 19 is stressed in a sprung manner, so that in the event of a required movement in the opposite direction, it shifts the guide part 14 or 15 carrying it back in the direction of the hot gas chamber 8. In order to carry out this task, the presses respectively associated with the same guide part 14 or 15 together reach an axial force which corresponds approximately to 10 times an axial force induced by operation and exerted by the gas stream 6 on the relevant guide part 14 or 15. In this case, both axial forces act in the direction of the gas outlet opening 9 and are added to each other.

The deformation energy absorbed by the stop rib 19 during its deformation is stored when a guide part 14 or 15 is displaced in the direction of the gas outlet opening 9 and, in the event of an opposing movement, serves to generate a restoring force. This restoring force is greater, in every position of the associated guide part 14 or 15, than the axial force exerted on the latter by the gas stream 6 and induced by operation. The restoring force is preferably about 2 to 3 times as great as the axial force induced by operation. As a result, each of the guide parts 14 and 15 is firmly clamped on the rigid rib 18 without play in every position.

It is to be understood that while certain forms of the invention have been illustrated and described, it is not to be limited to the specific forms or arrangement of parts herein described and shown. It will be apparent to those skilled in the art that various, including modifications, rearrangements and substitutions, may be made without departing from the scope of this invention and the invention is not to be considered limited to what is shown in the drawings and described in the specification. The scope of the invention is defined by the claims appended hereto.

What is claimed is:

1. A gas turbine comprising:

a casing having a gas duct disposed therethrough;

at least one group of stator blades disposed within said casing;

at least one group of rotor blades coupled to a rotor movably disposed within said casing;

at least one guide part disposed within said casing, said at least one guide part being axially displaceable with respect to said casing;

at least one ring mounted on said at least one guide part, said at least one ring forming an outer jacket of said gas duct and being selectably spaced apart from said at least one group of rotor blades, said least one ring being constructed and arranged to move with respect to said at least one group of rotor blades in response to axial motion of said least one guide part; and a motor constructed and arranged to selectively move said at least one guide part axially with respect to said casing, wherein said motor includes a plurality of presses operatively associated with said at least one guide part and wherein said presses include pistons each having a first end adapted to engage a rigid rib fixed to the casing.

2. The gas turbine as claimed in claim 1, wherein said presses include cylinders constructed and arranged to move with respect to said pistons in response to axial motion of said least one guide part.

3. The gas turbine as claimed in claim 1, wherein said at least one group of stator blades is mounted on said at least one guide part.

4. The gas turbine as claimed in claim 1, further comprising:

a stop rib projecting from said at least one guide part, said stop rib having a free end disposed against said rigid rib, said stop rib adapted for elastic deformation in response to motion of said presses.

5. The gas turbine as claimed in claim 4, wherein operation of said gas turbine produces a first force acting on said stop rib having a first magnitude; and aggregate motion of said presses produces a second force having a second magnitude, said second magnitude being greater than said first magnitude by at least a factor of ten.

6. The gas turbine as claimed in claim 4, wherein operation of said gas turbine produces a first force acting on said stop rib having a first magnitude; and a restoring force of said stop rib when elastically deformed has a second magnitude greater than said first magnitude.

7. The gas turbine as claimed in claim 6, further comprising:

a rotor blade tip gap disposed between said at least one group of rotor blades and said guide part, and wherein said restoring force displaces said at least one guide part, thereby enlarging said rotor blade tip gap.

8. The gas turbine as claimed in claim 4, wherein said stop rib includes an end stop constructed and arranged to limit the elastic deformation.

9. The gas turbine as claimed in claim 4, wherein said at least one guide part is secured against tilting both axially in front of and axially behind said stop rib and said rigid rib via a plurality of axial guide blocks distributed over the circumference of said at least one guide part.

10. The gas turbine as claimed in claim 9, wherein said axial guide blocks are attached to said casing.

11. The gas turbine as claimed in claim 9, wherein said presses are hydraulic.

12. The gas turbine as claimed in claim 9, wherein said presses are pneumatic.

13. The gas turbine as claimed in claim 1, wherein the guide pail has a funnel-like shape.

* * * * *